US007824283B2

(12) United States Patent
Lussier et al.

(10) Patent No.: US 7,824,283 B2
(45) Date of Patent: Nov. 2, 2010

(54) PRE-STRESSED HOCKEY SHAFT

(75) Inventors: Remi Lussier, Drummondville (CA); Marcel Jean, Drummondville (CA); Daniel Gatien, Drummondville (CA); Germain Belanger, St-Germain-de-Grantham (CA)

(73) Assignee: 2946-6380 Quebec Inc., Quebec (CA)

( * ) Notice: Subject to any disclaimer, the term of this patent is extended or adjusted under 35 U.S.C. 154(b) by 0 days.

(21) Appl. No.: 11/915,517

(22) PCT Filed: May 24, 2006

(86) PCT No.: PCT/CA2006/000848

§ 371 (c)(1),
(2), (4) Date: Jul. 16, 2008

(87) PCT Pub. No.: WO2006/125312

PCT Pub. Date: Nov. 30, 2006

(65) Prior Publication Data

US 2008/0312012 A1 Dec. 18, 2008

(30) Foreign Application Priority Data

May 25, 2005 (CA) ..... 2508313

(51) Int. Cl.
*A63B 59/06* (2006.01)

(52) U.S. Cl. ..... 473/561

(58) Field of Classification Search ..... 473/560–568, 473/544, 549–552, 316–323
See application file for complete search history.

(56) References Cited

U.S. PATENT DOCUMENTS

| | | | | |
|---|---|---|---|---|
| 3,813,098 | A | 5/1974 | Fischer et al. | |
| 4,410,183 | A | 10/1983 | Miller | |
| 4,629,190 | A * | 12/1986 | Borgen | 473/560 |
| 4,685,253 | A * | 8/1987 | Bitterly | 52/2.11 |
| 5,217,221 | A * | 6/1993 | Baum | 473/561 |
| 5,259,614 | A | 11/1993 | Greer | |
| 6,033,327 | A | 3/2000 | Bird | |
| 6,113,508 | A | 9/2000 | Locarno et al. | |
| 6,257,997 | B1 | 7/2001 | Doble et al. | |
| 6,361,451 | B1 * | 3/2002 | Masters et al. | 473/318 |
| 7,140,398 | B2 * | 11/2006 | Dodge et al. | 138/177 |
| 2002/0128087 | A1 | 9/2002 | Tilley | |
| 2002/0128093 | A1 | 9/2002 | Whayne | |
| 2003/0008734 | A1 * | 1/2003 | Tiitola | 473/560 |
| 2003/0017884 | A1 | 1/2003 | Masters et al. | |
| 2003/0100390 | A1 | 5/2003 | Bellefleur et al. | |
| 2003/0144071 | A1 | 7/2003 | Dodge et al. | |

(Continued)

FOREIGN PATENT DOCUMENTS

| | | |
|---|---|---|
| CA | 1061669 | 9/1979 |
| CA | 1170287 | 7/1984 |
| CA | 2166699 | 1/1995 |
| CA | 2266981 | 9/1999 |
| CA | 2435340 | 5/2004 |
| CA | 2139556 | 4/2008 |
| EP | 0 761 419 | 3/1997 |
| WO | 99/20357 | 4/1999 |
| WO | 01/43835 | 6/2001 |

*Primary Examiner*—Mark S Graham
(74) *Attorney, Agent, or Firm*—Meyertons, Hood, Kivlin, Kowert & Goetzel, P.C.; Eric B. Meyertons

(57) ABSTRACT

A hockey stick comprising a shaft portion and a blade portion, the shaft portion including means having preformed stresses to induce a flexural resistance at about mid-span so as to create in the shaft portion induced stresses which are neutralized as stresses are further induced in the shaft portion at impact on the blade portion to thereby provide a stiffer and more rigid shaft portion.

4 Claims, 8 Drawing Sheets

U.S. PATENT DOCUMENTS

2003/0216197 A1* 11/2003 LeMire et al. ..... 473/562
2003/0224869 A1 12/2003 Soong
2003/0224870 A1 12/2003 Soong
2004/0102263 A1* 5/2004 Blotteaux ..... 473/561
2004/0214007 A1* 10/2004 Brown et al. ..... 428/417
2005/0187046 A1* 8/2005 Kavanaugh ..... 473/560
2006/0089215 A1* 4/2006 Jean et al. ..... 473/560
2006/0122013 A1* 6/2006 Dodge et al. ..... 473/516

* cited by examiner

PRE-STRESSED HOCKEY SHAFT

CROSS-REFERENCE TO RELATED APPLICATIONS

This application is a National Entry Application of PCT application no. CA2006/000848 filed on May 24, 2006 and published in English under PCT Article 21(2) under number WO 2006/125312, which itself claims priority on Canadian patent application no. 2,508,313, filed on May, 25, 2005. All documents above are incorporated herein in their entirety by reference.

FIELD OF THE INVENTION

The present invention relates to a hockey stick, which consists of a handle portion, or shaft, and a blade portion, or blade.

BACKGROUND OF THE INVENTION

Up till now, all hockey stick shafts, either of solid or hollow construction, have been manufactured in a similar standard rectangular configuration. This standard rectangular configuration has been the standard shape, which is preferred by a majority of hockey players. These actual designs of rectangularity have various radiuses placed at the intersecting planes (horizontal and vertical), and some of them include a cross sectional configuration of concaved/sided walls.

Composite hockey stick shafts, depending on their method and materials of construction, exhibit superior characteristics to hockey stick shafts of wood with respect to tensional resistance, bending moment resistance and shear resistance. However, composite hockey stick shafts have an inherent relative flexibility when submitted to direct impact at the blade, on particular under slap shot condition. A hollow rectangular beam structure, such as a hockey stick shaft, will, under a sudden cantilever type of loading (slap shot), exhibit a non-negligible deflection at mid span between the hockey player's hands localization. Such bending moment forces are transmitted inside the thin wall composite fiber-resin matrix construction and generate compression tension and shear stresses in the fiber-resin laminate.

The resulting level or amplitude of deflection between the player's hands (known as the buckling phenomenon) will be directly related to the area moment of inertia (dependent on the wall thickness) and the flexural elastic modulus of the fiber-resin laminate. Higher are the wall thickness and the laminate elastic modulus, higher is the overall stiffness and lower is the buckling phenomenon between the player's hands, but higher wall thickness involves higher weight of the shaft.

In some cases, due to the player's personal interest in added rigidity, higher bending resistance or a judicious combination of "stiffness—flex" in that particular zone will normally generate a quicker energy transfer allowing the player to deliver more dynamic and accurate puck releases.

Players who choose to play with composite hockey sticks continually seek out sticks having adapted rigidity and low weight. Experience has shown that conventional laminate constructions such as carbon, Kevlar and epoxy are close to attain a limit to maximize shot velocity and control, and increase durability and strength.

Objects and Statement of the Invention

It is an object of the present invention to provide a hockey stick with a quicker energy shaft loading under minimal flexural deformation.

It is a further object of the present invention to provide a hockey stick with a rapid energy transfer right after the contact between the puck and the blade of the stick.

It is a further object of the present invention to provide a hockey stick with an energy charge in the shaft, which will be delivered at 100% in a shortest time possible.

These objects can be obtained with the present invention by providing, at mid span of the handle portion of the hockey stick, means having preformed stresses handle portion, which will induce flexural resistance. This creates induced stresses in the body, which will be later neutralized at impact as further stresses are induced.

There results a stiffer and more rigid handle portion for the hockey stick.

Other objects and further scope of applicability of the present invention will become apparent from the detailed description given hereinafter. It should be understood, however, that this detailed description, while indicating embodiments of the invention, is given by way of illustration only, since various changes and modifications within the spirit and scope of the invention will become apparent to those skilled in the art.

IN THE DRAWINGS

Figure 9:
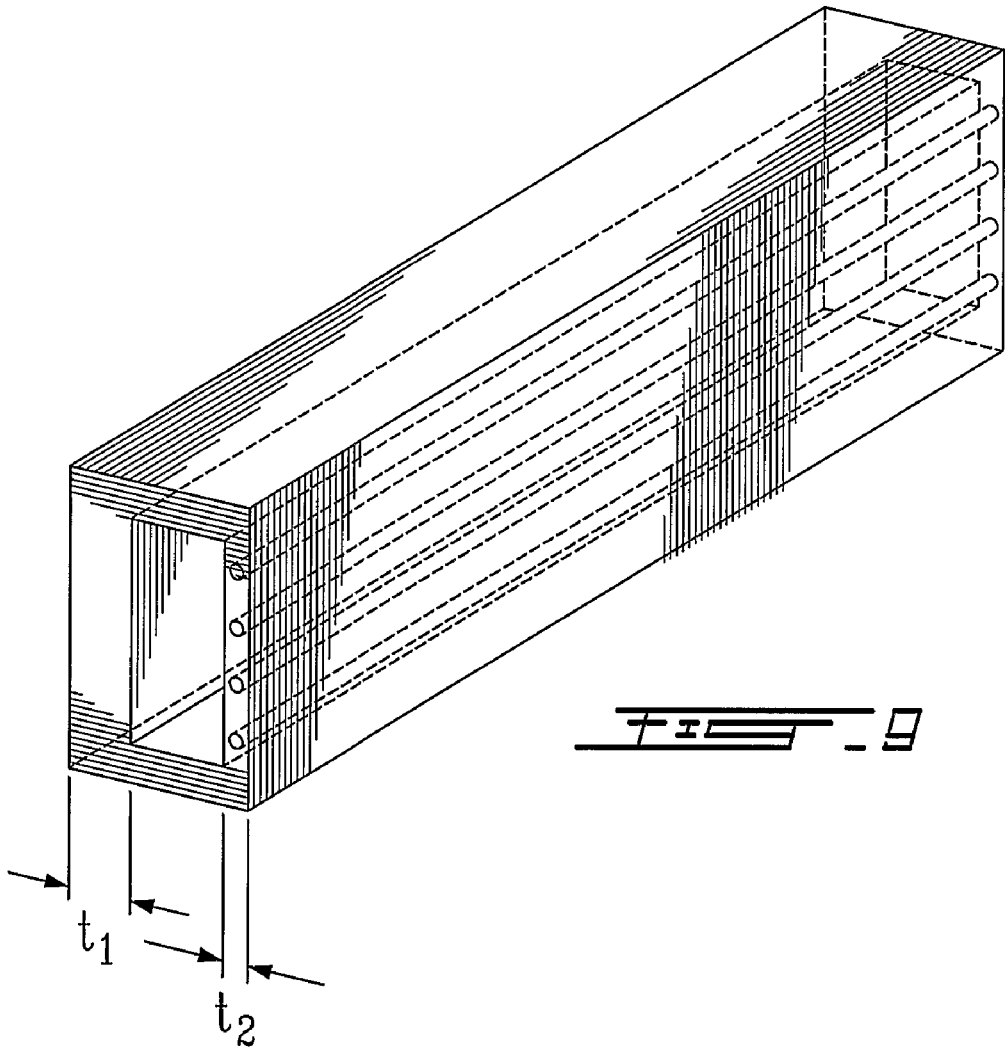
Figure 10A:
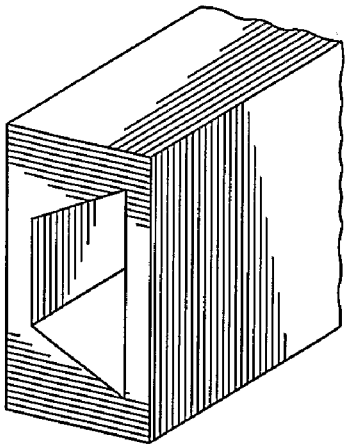
Figure 10B:
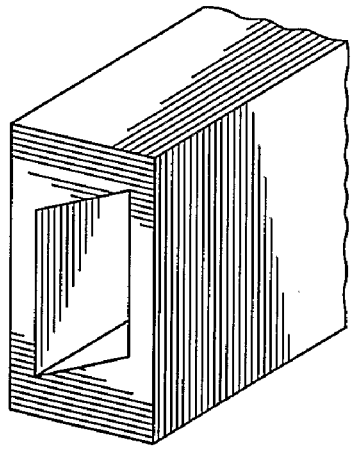
Figure 11:
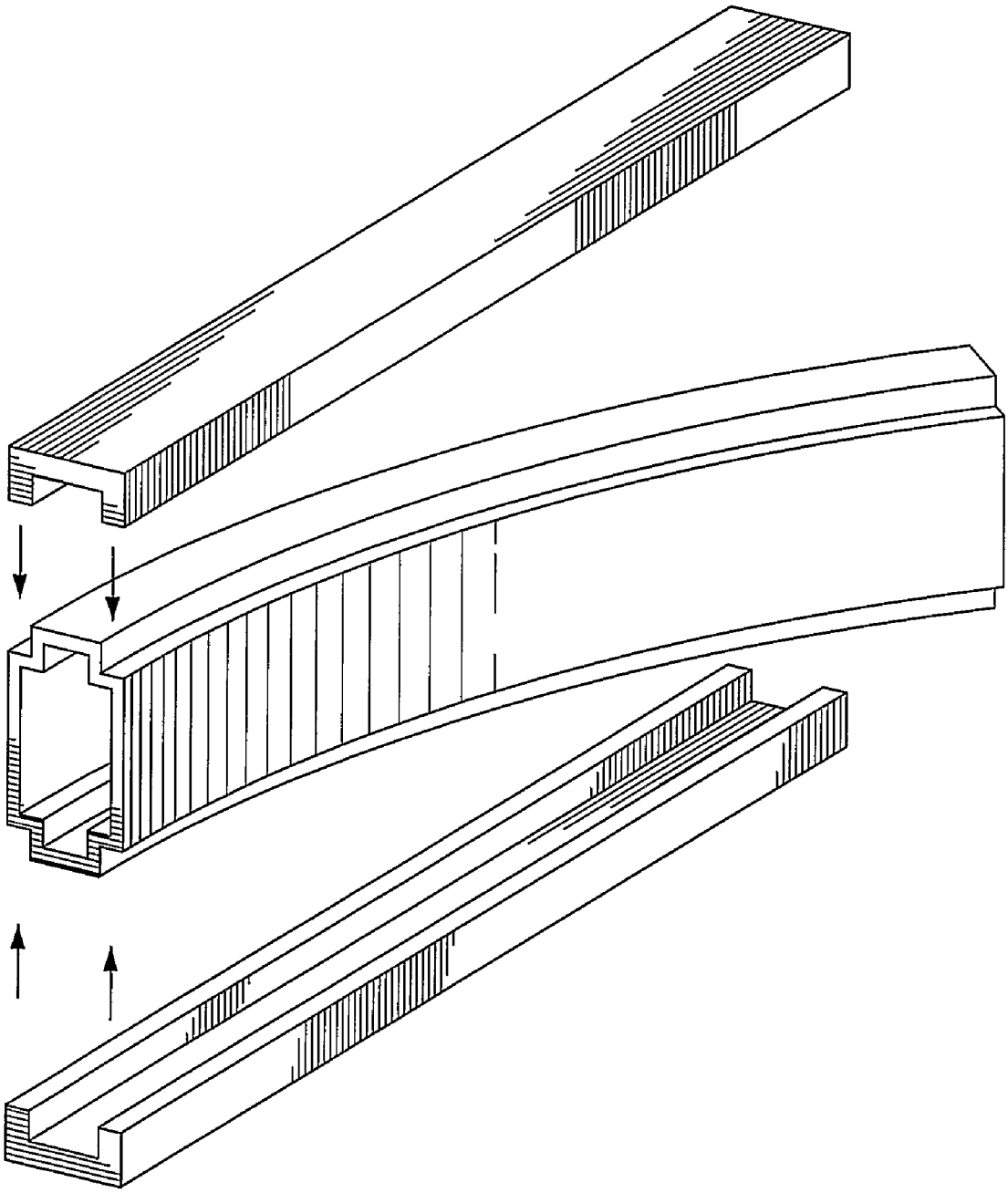
Figure 12:
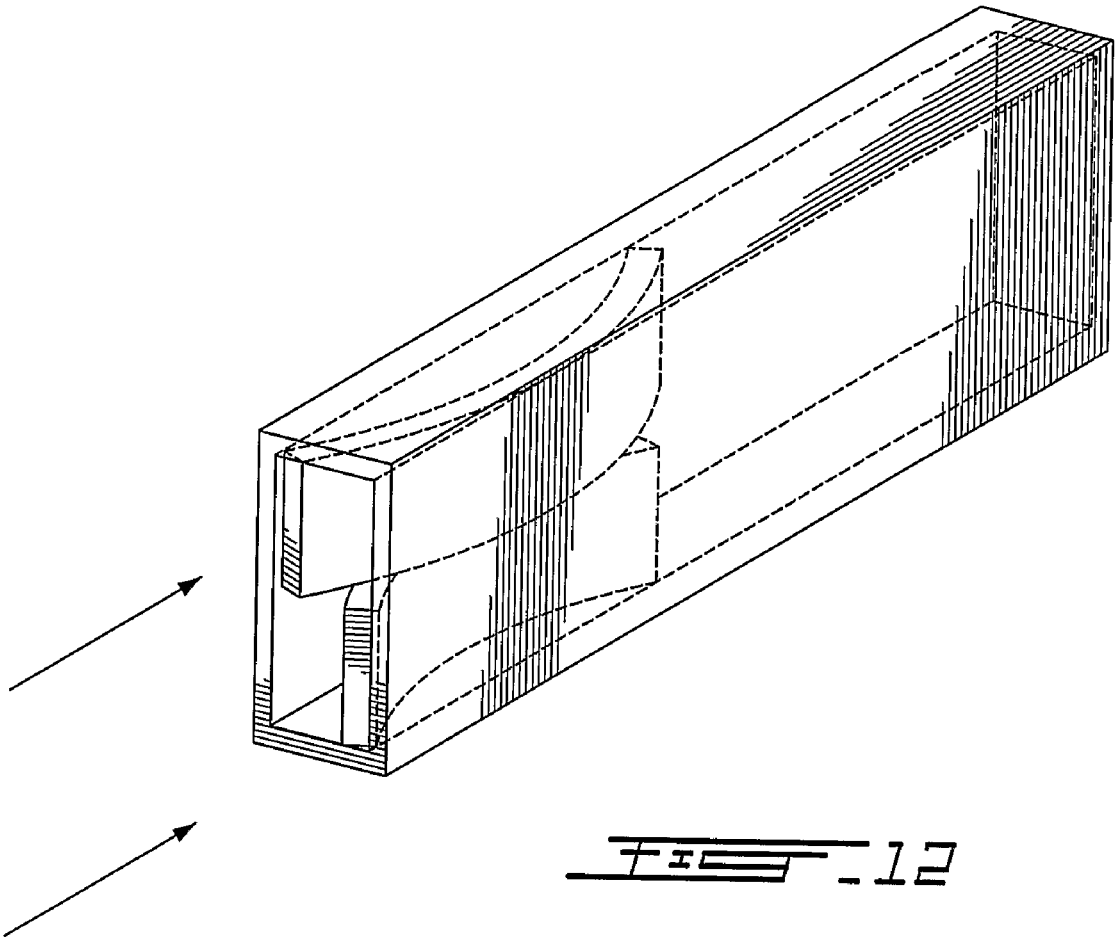
Figure 13:
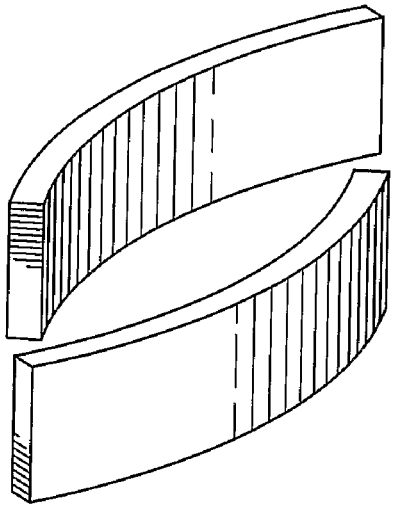

FIGS. 9, 10*a* and 10*b* show various arrangements of a third embodiment of the present invention;

FIG. 11 is a perspective view showing a fourth embodiment of the present invention;

FIGS. 12 and 13 show a fifth embodiment of the present invention; and

Figure 14:
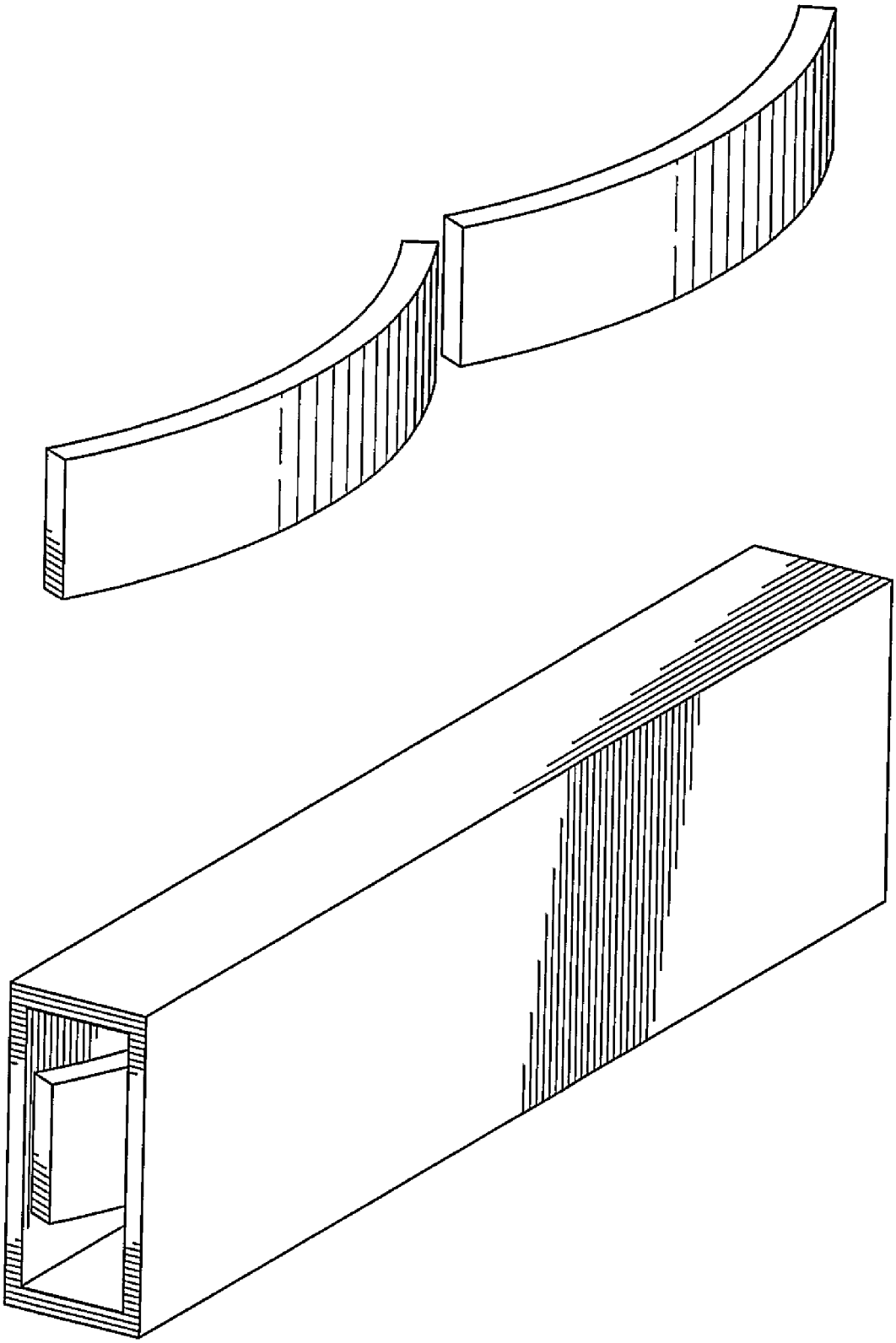
Figure 15:
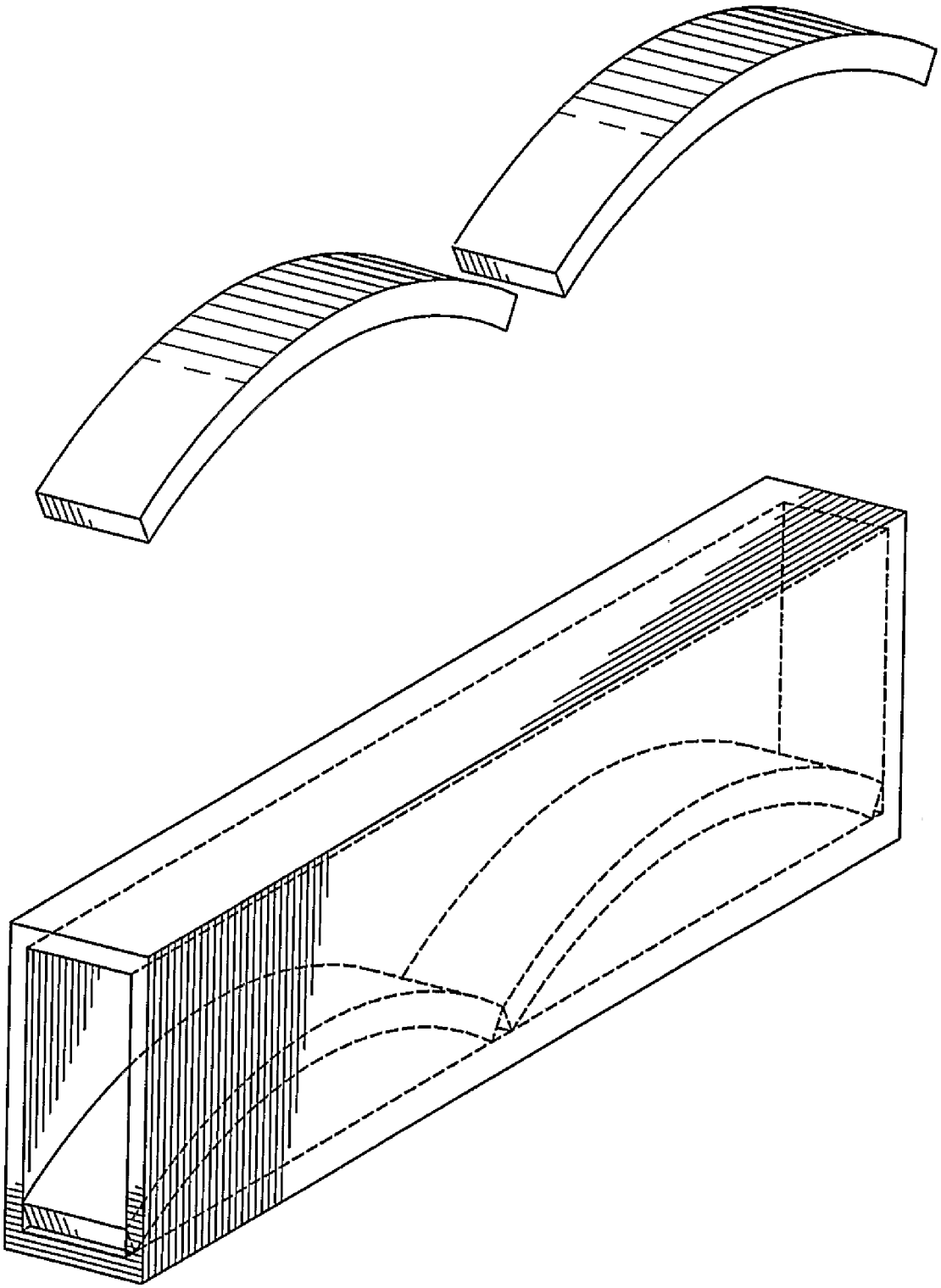

FIGS. 14 and 15 show a sixth embodiment of the present invention.

DESCRIPTION OF EMBODIMENTS

First Embodiment

As shown in FIGS. 1-6, the force element may consist of a composite mono or bi-leaf spring that stores potential energy when pre-deformed before installation.

Depending of its geometry and strength, the composite spring will induce a preferential flexural resistance in the form of a multi point preloading stresses inside the tubular hockey shaft.

When submitted to an impact load, such as in slap shot, the bending moment induced in the hockey shaft must, first counterbalance the pre-induced flexural stresses by the spring insert localized inside the rectangular shaft before generating a deflection at mid span of the hockey shaft (when referring to the hockey player's hands position).

By definition, a composite mono-leaf bow spring has a central upwardly curved region introduced between two downwardly curved regions that are introduced between two more upwardly curved regions.

By varying the curvature, either the upwardly curved regions or downwardly curved regions, or by varying the construction of the leaf spring, the rate of displacement along each portion of the multi linear deflection response curve may be controlled.

Because of the composite material high specific strain energy storage capability and the possibility to design and fabricate a linear spring having continuously variable width and/or thickness along its length, such design features should lead to a more adapted hockey shaft.

The mono-leaf bow spring can achieve a multi linear deflection response when compressed under load. Also, it can be symmetrically or asymmetrically designed, depending upon the application requirement.

In some cases, the composite spring could have a sinusoidal profile with variable cross-section, always depending of the specific function requirements.

Normally the stiffness of the spring is directly related to the area moment of inertia of the section. The material in the central area of the solid cross-section of the leaf spring does not significantly contribute to the bending stiffness.

It could then be beneficial to manufacture a composite spring having a hollow cross-section being much lighter and having the same stiffness as for a solid area.

Hence, the embodiment consists in the prefabrication and installation of a linear spring having the geometry of a sinusoidal wave or a mono-leaf bow contacting in four different points inside the rectangular tubular hockey shaft, wherein two of the contact points are at the player's hand localization or slightly eccentric or displaced and the two other points at each end of the hockey shaft.

Before installation, the linear leaf spring is pre-deformed to be subsequently slid inside the tubular shaft and released. After releasing, the linear spring still has a deformation resulting (by reaction) in a flexural pre-stressed hockey shaft.

The induced flexural stresses resulting from the pre-deformed linear spring inside the hockey shaft will be oriented in a way as to resist to the shaft deformation when submitted to impact such as in slap shot conditions.

When the hockey blade impacts the puck, the stresses induced by the flexural moment (cantilever type) will have first to neutralize the one induced by the pre-stressed spring before to act directly on the shaft itself, resulting in a stiffer and more rigid hockey shaft.

As a variant of the present embodiment of the invention, the rectangular shaft may be molded with a curved shape and following its straightening, a rectangular profile called <<single blade>>, "D" (shown in FIG. 4) may be slid inside the shaft (FIG. 6) to keep it permanently straight and pre-stressed.

Second Embodiment

Figure 1:
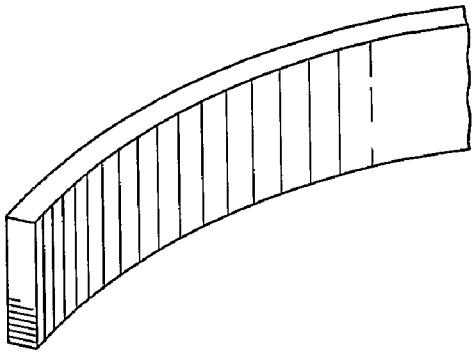
FIGS. 1-6 show various elements illustrating a first embodiment of the present invention.
Figure 2:
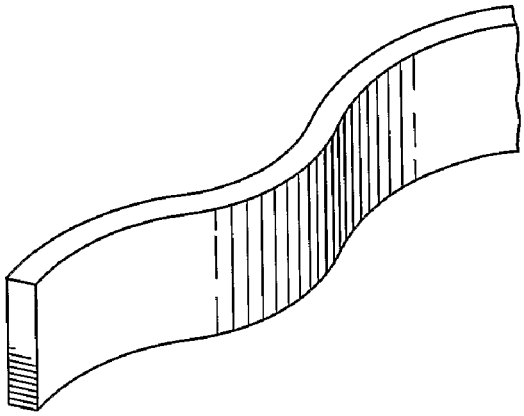
Figure 3:
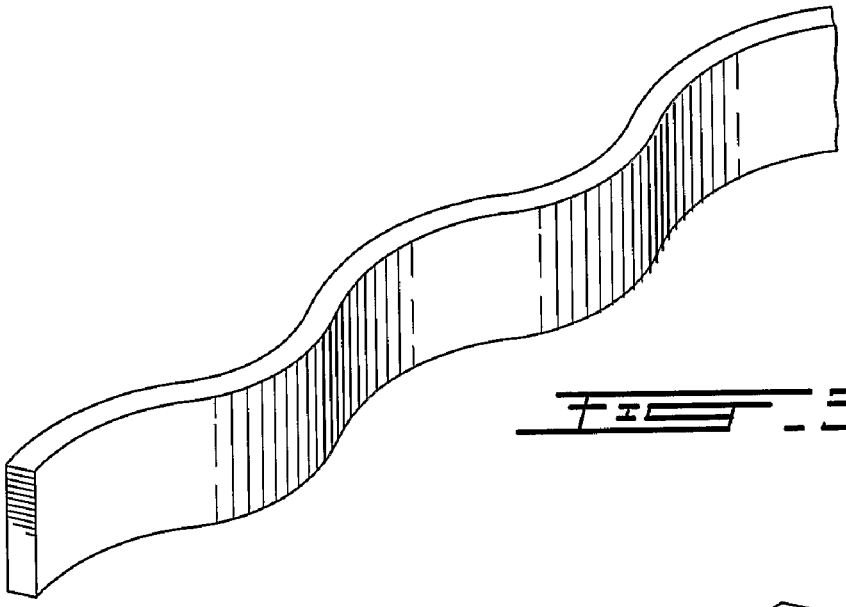
Figure 4:
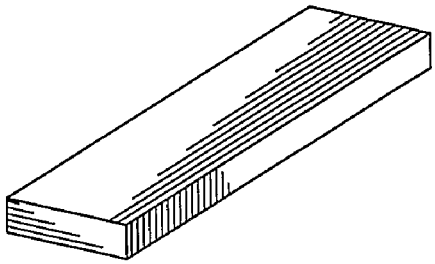
Figure 5:
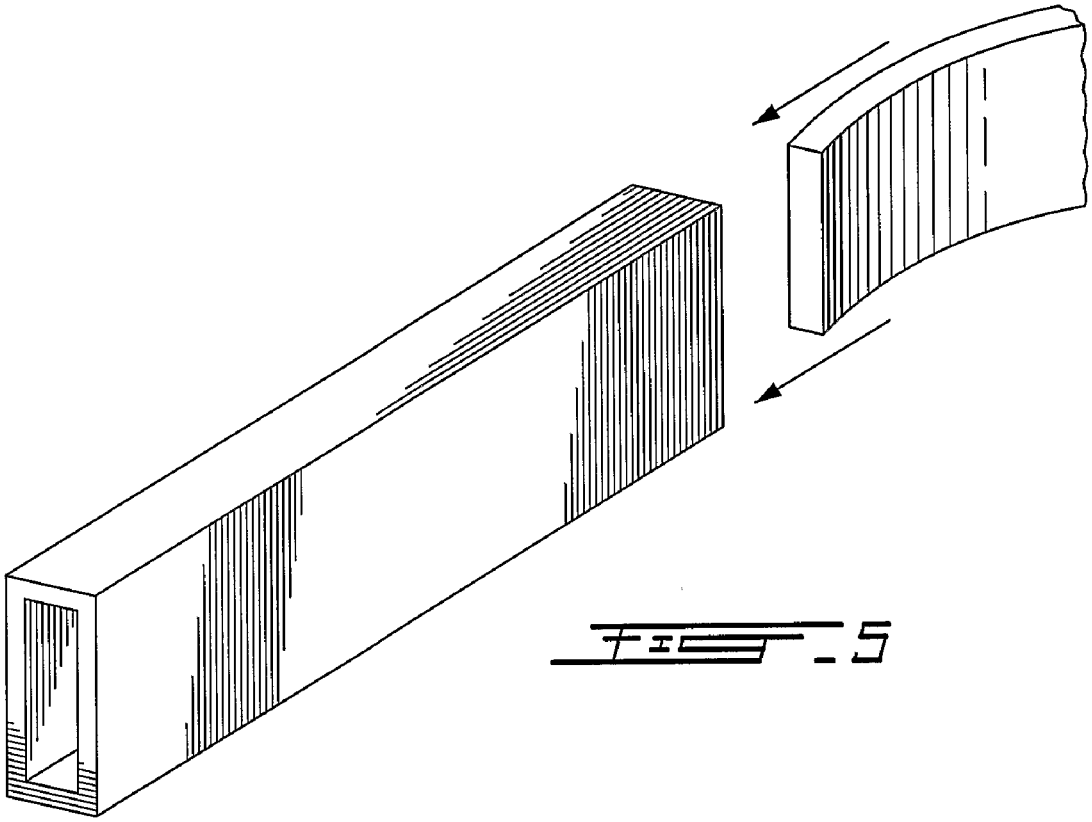
Figure 6:
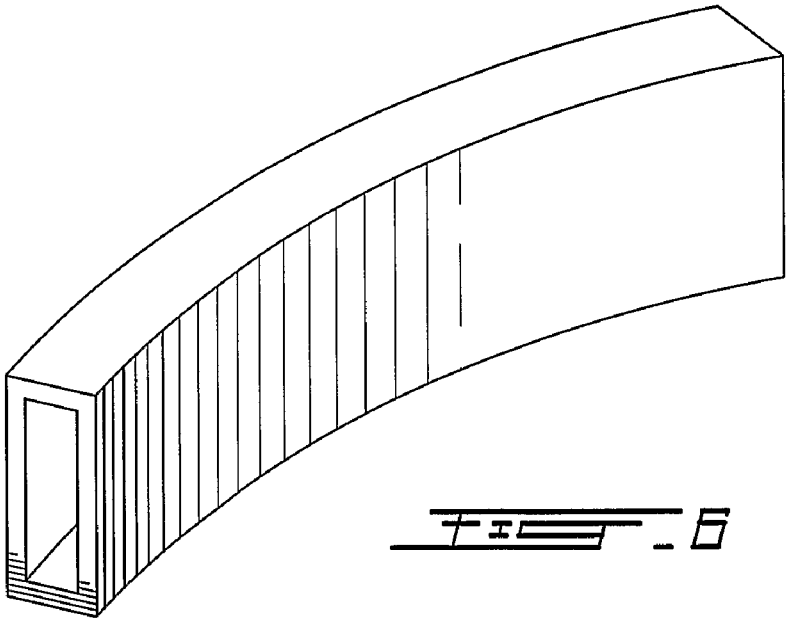
Figure 7:
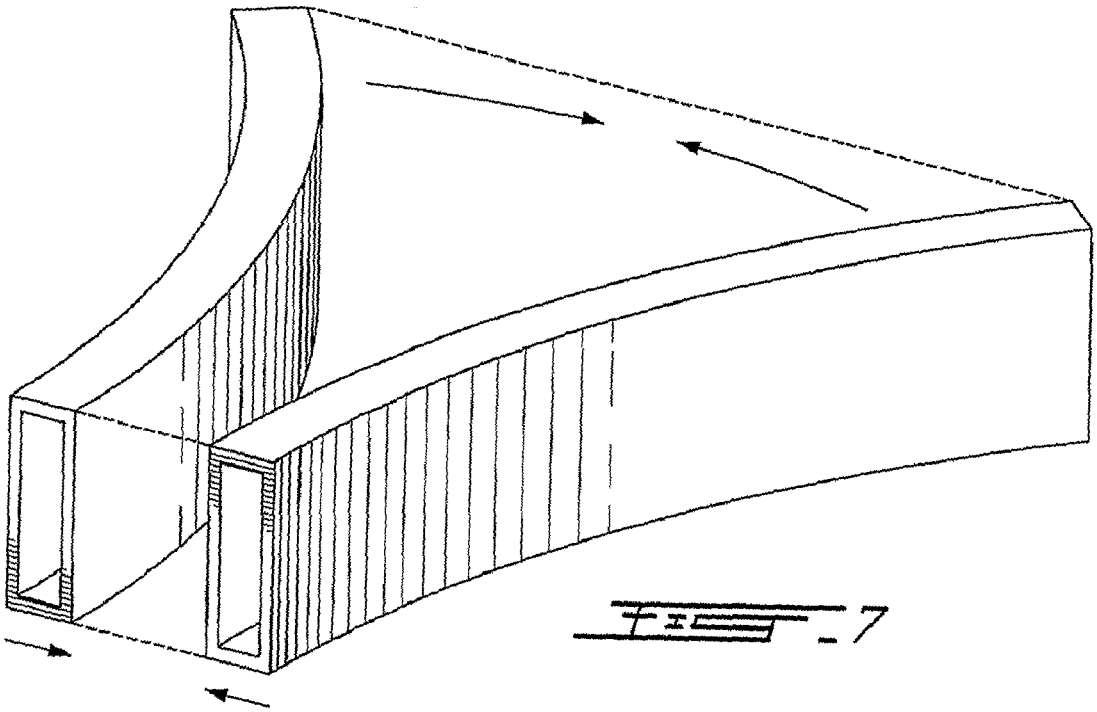
FIGS. 7 and 8 show elements of a second embodiment of the present invention.
Figure 8:
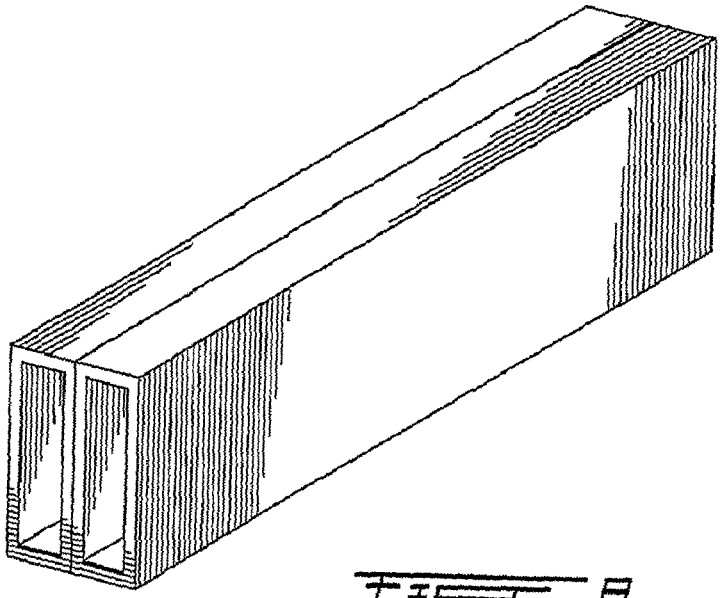

As shown in FIGS. 7 and 8, the hockey shaft is fabricated in two longitudinal halves, each one having a rectangular or trapezoidal profile. When moulded, these two halves are curved (more as a bow) and secured into a permanent assembly side-by-side with the particularity to be back to back in a concave condition.

After being compressed transversely, the two halves are permanently assembled by bonding, over wrapping or any other way.

The final hockey shaft assembly will have the same visual aspect as a standard shaft but with the added property to be a pre-stressed hockey shaft (in flexural condition).

The level of energy storage is directly related to the curvature amplitude, which is particular to each hockey shaft halves, combined to their inherent stiffness and strength.

Third Embodiment

As shown in FIG. 9, in a first variant, the rectangular shaft has uneven wall thicknesses and to counterbalance and pre-stress the shaft, wires are embedded inside the thinnest wall after being pre-stressed in tension.

As shown in FIGS. 10*a* and 10*b*, in a second variant, the internal profile of the cross section is not rectangular, but more in a parallelogram or trapezoidal shape with the result that the circumferential wall thicknesses is not uniform. As in the first variant, wires would be pre-tensioned before being embedded in the thinnest wall section.

Fourth Embodiment

As shown in FIG. 11, the basic hockey shaft having a rectangular profile may be molded and curved (with linear recess) to be straightened and locked in place permanently with the use of two straight grooved molded planks. The result is a pre-stressed shaft permanently assembled with adhesive.

Fifth Embodiment

As shown in FIGS. 12 and 13, this embodiment is a variation of the first embodiment with the difference that two spring inserts are used inside the rectangular shaft; these spring inserts are immersed and superposed to generate a counterbalancing pre-stress effect (asymmetric).

Sixth Embodiment

As shown in FIGS. 14 and 15, this embodiment is a variation of the first embodiment with the difference that two springs inserts are used end-to-end allowing pre-stressing at asymmetric location and with asymmetric pre-stressing loads. Springs may be inserted in the vertical or in the horizontal plane.

Concepts

The above-described six embodiments can be regrouped in three basics concepts.

A first concept consists of a straight molded hockey shaft in which the secondary component (one or two spring-type pieces) is slid therein to generate more stiffness. This concept may be found in the above-described first, fifth and sixth embodiments.

A second concept consists of a straight molded shaft having a variable wall thickness in cross-section and in which continuous wire reinforcements are admitted in one of the sides. This concept may be found in the third above-described embodiment.

A third concept consists in a curved molded shaft in one or two molded pieces that are straightened and locked in place. This concept is found in the above first, second and fourth embodiment. In a first variant, the hockey stick consists in a single molded shaft that is locked in place (after straightening) with a secondary component installed inside or outside the tubular shaft and mounted in place. In a second variant, the hockey stick consists in two-molded half-size curved molded shaft that are bound back to back after straightening.

First Concept

When a straight tubular hockey shaft is molded, it possesses a particular rigidity resulting from its construction (fiber—polymer resin—fiber orientation—fiber/resin ratio—relative thicknesses of each layer of reinforcement—total thickness of shaft wall). The rigidity or stiffness factor being directly dependent of the elastic modulus (E) and surface inertia moment (I), its value may be raised without changing any of the variables list mentioned previously. A device is incorporated inside the shaft with the result that, under impact (slap shot), the shaft will deflect less and return the accumulated energy under deformation faster and quicker. The net result will be that the puck (with a constant energy input) leaves the blades quicker and travels faster.

The device is basically a leaf spring, which, after a specific deformation, is slid and fixed inside the tubular shaft. Different spring rate can be obtained by varying, in a fixed geometry, the content of fiber and resin.

A steel leaf spring has a very high modulus of elasticity; but, with carbon fiber embedded in a thermoset resin, it is possible to obtain superior value.

Also, an additional benefit is obtained by the high elastic strain energy inherent in a composite laminate; it can be more than 10 times that of steel.

By combining different arc portions of the leaf spring (radius not constant), it is possible to obtain a continuous non-linear variable spring deformation rate. Under deformation, it is possible to create different reactive forces at different locations (ex.: hand positions on a hockey shaft).

Second Concept

The concept of using an asymmetric wall thickness (thickness variation on some of the four sides of the tubular shaft) has for objective to generate a hockey shaft having a different stiffness when used frontward and backward.

With the integration of preloaded reinforcing wires on the thin side, it is possible to adjust preferentially the stiffness or rigidity in the hockey shaft.

By a proper choice of the ratio $t_1/t_2$ combined to the right number of reinforcing wires and the level of preloading in tension, it is possible to stiffen preferentially in one direction the hockey shaft with the objective to create a hockey stick which delivers the puck quicker and faster.

Third Concept

The concept to straighten a pre-molded curved shaft (single or double) offers the largest variety of options to obtain different levels of pre-stressed hockey shafts.

By defining exactly the curve amplitude of the hockey shaft for a determined construction, it is possible to generate the new flexural elastic modulus, resulting in a higher stiffness factor or higher shaft rigidity (more curved more energy required to straighten it and a stiffer hockey shaft at use).

The option to use two half-molded shafts bonded back to back has the particularity to simplify the assembly procedure.

When only one molded shaft is used, an accessory is required to lock it in position; however, it provides a lighter shaft.

In all these concepts, composite material is used to keep weight at a minimum and stiffness at a maximum. High modulus carbon fibres are part of the solution.

By carefully designing the shape of the components, the material system and the assembly technique, rigidity and stiffness of the hockey shaft is upgraded generating a quicker and faster puck release from the hockey blade, when compared to a conventional composite hockey shaft with pre-stressing in its tubular walls.

Although the invention has been described above with respect to various embodiments, it will be evident that it may be modified and refined in various ways. It is therefore wished that the present invention should not be limited in interpretation except by the term of the following claims.

The invention claimed is:

1. A stiff and rigid hockey stick with a flexural pre-stressed shaft comprising a shaft and a blade attached to an extremity of the shaft, said shaft comprising a pre-stressed portion at mid span of the handle portion, along a length thereof, said pre-stressed portion comprising preformed stresses, said preformed stresses being neutralized, as stresses are further induced in said shaft at impact on said blade, before generation of a deflection at the mid span of the handle portion, wherein said shaft comprises at least one curved molded piece, said at least one curved molded piece being straightened and locked in place, forming said pre-stressed portion.

2. The hockey stick of claim 1, wherein said shaft comprises carbon fibers embedded in a thermoset resin.

3. The hockey stick of claim 1, said shaft comprising a single molded curved piece, said single molded curved piece being straightened and locked in place with a secondary component bonded to one of: i) the inside and ii) the outside of the shaft.

4. The hockey stick of claim 1, said shaft comprising two curved molded half shafts, said half shafts being bonded back to back after straightening.

* * * * *